US009138753B1

(12) United States Patent
Takahara

(10) Patent No.: US 9,138,753 B1
(45) Date of Patent: Sep. 22, 2015

(54) SPRAY NOZZLE AND THE APPLICATION

(75) Inventor: Hiroshi Takahara, Oakland, NJ (US)

(73) Assignee: Hiroshi Takahara, Wayne, NJ (US)

( * ) Notice: Subject to any disclaimer, the term of this patent is extended or adjusted under 35 U.S.C. 154(b) by 298 days.

(21) Appl. No.: 12/807,407

(22) Filed: Sep. 2, 2010

(51) Int. Cl.
*B05B 1/26* (2006.01)
*B05B 1/02* (2006.01)

(52) U.S. Cl.
CPC ..... *B05B 1/02* (2013.01)

(58) Field of Classification Search
CPC ..... B24C 5/04; B05B 7/08
USPC ..... 239/543, 545, 504, 418, 422, 434.5, 239/398, 290, 291, 296, 589, 590.5, 592
See application file for complete search history.

(56) References Cited

U.S. PATENT DOCUMENTS

| | | | |
|---|---|---|---|
| 3,045,923 | A | 6/1959 | Steine |
| 3,754,710 | A | 8/1973 | Chimura |
| 4,097,000 | A | 6/1978 | Derr |
| 4,646,977 | A | 3/1987 | Iwamura |
| 4,905,911 | A | 3/1990 | Sakuma |
| 4,928,884 | A | 5/1990 | Smith |
| 5,088,649 | A | 2/1992 | Hanson |
| 5,110,048 | A | 5/1992 | Waldrum |
| 5,167,371 | A | 12/1992 | Rohner |
| 5,370,317 | A | 12/1994 | Weston |
| 5,597,122 | A | 1/1997 | Eisenmann |
| 6,086,812 | A | 7/2000 | Crampton |
| 6,390,386 | B2 | 5/2002 | Krohn |
| 6,817,493 | B1 | 11/2004 | Parsons |
| 7,128,283 | B1 | 10/2006 | Shahin |
| 2005/0011652 | A1 * | 1/2005 | Hua ..... 169/37 |

FOREIGN PATENT DOCUMENTS

| | | |
|---|---|---|
| DE | 2713738 | 9/1978 |
| DE | 2724173 | 1/1983 |
| DE | 3414880 | 6/1987 |

(Continued)

OTHER PUBLICATIONS

Arthur H. Lefebvre, Atomization and Sprays, 1989, Hemisphere Pub. Corp. p. 10, 55, 41 and 70.
L.Bayvel and Z.Orzechowski, Liquid Atomization, 1993, Taylor & Francis. p. 2-24 and 57.

(Continued)

*Primary Examiner* — Davis Hwu

(57) ABSTRACT

A spray nozzle for providing a high efficient atomization and a uniform fluid flow pattern, includes an internal fluid channel, sealing and a spray nozzle, on which two of spray orifices are designed close to each other. The fluid flow is guided in the internal fluid channel smoothly and separated to two fluid flows inside of spray nozzle. These two fluid flows are pressed out from the spray orifices and interfered with each other right after flow out from the spray orifices. The fluid is being atomized efficiently because the spray nozzle is designed to fully utilize both flow velocity energy and flow pressure potential energy, which is well known as "Potential Core" or "Potential Zone" and will disappear in a very short distance right after fluids flow out from the spray orifices. During the fluid flows collide with each other by using the flow velocity right after flow out from the orifices, the fluid flows explode within the potential core by using the flow pressure potential energy. And then, the fluid flow and the fluid particles are continuously atomized by using the velocity difference between the fluid flow and the air around the fluid flow to have very fine particles.

6 Claims, 4 Drawing Sheets

(56) References Cited

FOREIGN PATENT DOCUMENTS

| | | |
|---|---|---|
| GB | 2157592 | 10/1985 |
| JP | 51857 | 11/1985 |

OTHER PUBLICATIONS

G.G. Nasr, A.J.Yule and L.Bendig, Industrial Sprays and Atomization, 2002, Springer. p. 12-16.

* cited by examiner

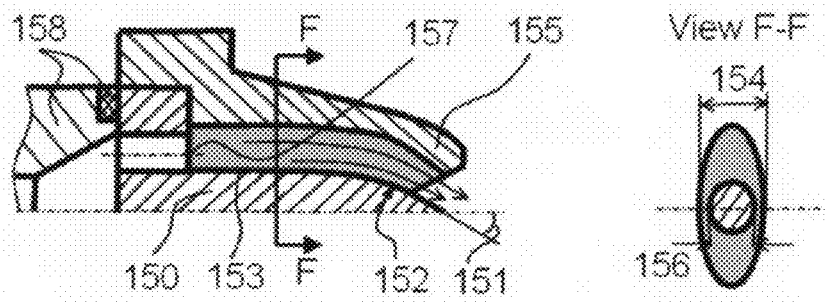
Fig.4 Nozzle with Isolation Insert
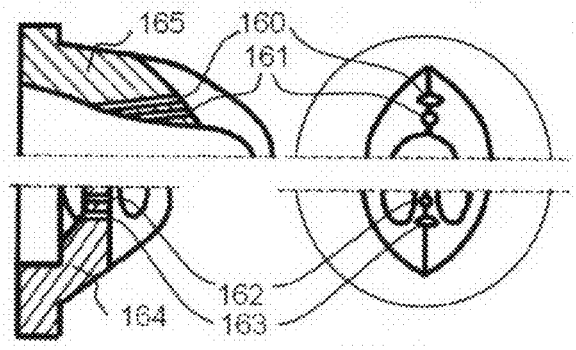
Fig.5 Assistant Holes
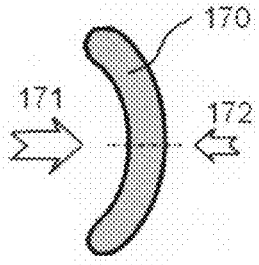
Fig.6 Flow Pattern Section

SPRAY NOZZLE AND THE APPLICATION

BACKGROUND OF THE INVENTION

1. Field of the Invention

This invention relates to a spray nozzle for high pressure, airless spraying of paint and other fluids, and more particularly, to a spray orifice design, which produces a uniform fluid flow pattern and high efficient atomization. The new spray nozzle is designed to fully utilize both flow velocity energy and flow pressure potential energy, which exists in the fluid flow near to spray orifices. It has a wide application in various industrial fields.

2. Description of the Related Art

The current airless spray nozzle requires a high fluid velocity at the nozzle outlet under a high pressure to obtain a high fluid atomization flow pattern. The spray nozzle outlet is designed to various shapes to meet the fluid flow pattern requirements as well. The fluid flow is adjusted and guided at inside of the nozzle before flowing out. Under a high pressure, the fluid is pressed out from the nozzle and atomized starting from the boundary to the center of the fluid flow during the fluid mixing with the gas/air. This procedure is known as a free flow jet. The area before mixing and atomizing with the gas/air is called a potential core with the potential core length Xp. The concept of atomization is that a big velocity difference exists between fluid flow and the gas/air, which is pushing, peeling and mixing the fluid with the gas/air from outside of the fluid flow to the center line to perform an atomization gradually. There are many spray nozzles such as the Plain Orifice Spray Nozzle, V-cutter Fan Spray Nozzle, Ring Spray Nozzle, etc which are developed by using this concept.

There is another type of spray nozzle designed with two fluid outlet holes. The fluid is pressed out with a low pressure from these holes to two streams and collides at the intersection point of the stream center lines to form fine drops and a flow pattern. Since the fluid potential pressure has been decreased to zero and the fluid velocity is relative low, there is very minor or non-atomization proceeded before fluid collision.

There is one more type of spray nozzle installed with several semi-internal atomization nozzles. The fluid is collided in these semi-internal atomization nozzles and forms fluid steams and/or fluid droplets, which flow out from each nozzle at relatively lower speed. These fluid steams and fluid droplets will collide again at a same point from each nozzle to form a uniform flow pattern.

All of these technologies are applied and used for many industry fields, such as airless, airless and air assistance spray systems, static airless spray units, vehicle and aircraft engine fuel jets, oven oil nozzles, agricultural operations, fire prevention system, etc. However, these technologies were not designed to let the fluid collide in the potential area or core. They were simply designed according to the free flow jet theory only, or the fluid flow collision theory. In other words, these technologies did not fully utilize both fluid potential energy and fluid velocity energy efficiently.

The objectives of this invention is to provide a concept and design for spray nozzles to fully utilize both flow pressure potential energy and flow velocity energy. This way, both potential energy and velocity energy are transformed from fluid flow to fluid particles directly and the fluid flow is atomized more efficiently and as a result, provides a better atomization flow pattern.

SUMMARY OF THE INVENTION

In accordance with this invention, a spray nozzle provides a direct and efficient way to produce a uniform fluid flow pattern and fine atomization with a less power or lower pressure requirements.

The spray nozzles of this invention are designed to guide and separate the fluid flow into two main flows before flowing out from the spray orifices. Because the orifices are designed very close each other with an optimal flow angle, these two flows interfere with each other inside the potential core right after the nozzle outlet. The fluid is atomized according to the free flow jet theory and the fluid flow collision theory at the same time. During atomizing in the potential core, the fluid flow and the fluid particles are changing the flow direction inside and outside of the potential core, which helps efficiently utilize and transform both flow pressure potential energy and flow velocity energy from the fluid flow to the fluid particles and the fluid particles to other fluid particles.

Based on this concept and the design, the atomization is improved greatly compared to existing nozzles flowing fluid at the same pressure. In other words, to have the same atomization result, we only need 50%+/−30% of pressure/power compared with original spray requirements. As an example, to keep the same atomization requirements with the same paint flow rate, we can design a spray nozzle with a larger size orifice up to 1.4-2.0 times from the existing one, or require a much lower pressure, such as 1000 psi instead of 2000 psi, using a regular airless spray gun.

Advantages

Accordingly several advantages of this invention are as follows: to develop spray nozzles with internal and external designs that perform the fluid flow pattern and distribution fluidly and dynamically during interfering and changing the fluid flow and the particles' direction, and eliminate any unexpected flow and/or the spots.

It will reduce waste from fluid flow bounce back because the particles are under a lower pressure, which meets the environment requirement to save fluids used; such as paints for many external applications.

It will increase the efficiency with a better atomization for many internal applications such as the engine fuels, oils, oven, etc.

It will greatly avoid and reduce possible injuries and deaths because of applying with a lower fluid pressure.

It noticeably reduces the fluid pressure and require less power compared to prior arts. In other words, this new technology will save energy which in turn will reduce the power needed to run a variety of equipment, such as the spray piston pumps, power suppliers, etc for the end users.

Other advantages will be apparent from a consideration of the drawings and ensuring description.

DESCRIPTION OF THE DRAWINGS

Figures

These and other objects and the attendant advantages of this invention will be readily appreciated as the same becomes better understood by reference to the following detailed description taken in conjunction with the preferred embodiment thereof with reference to the accompanying drawings, in which:

FIG. 4 shows the third configuration of spray nozzle design.

FIG. 5 and FIG. 6 show the application by using the design and the concept.

DETAILED DESCRIPTION OF THE ILLUSTRATED EMBODIMENT

Figure 1A:
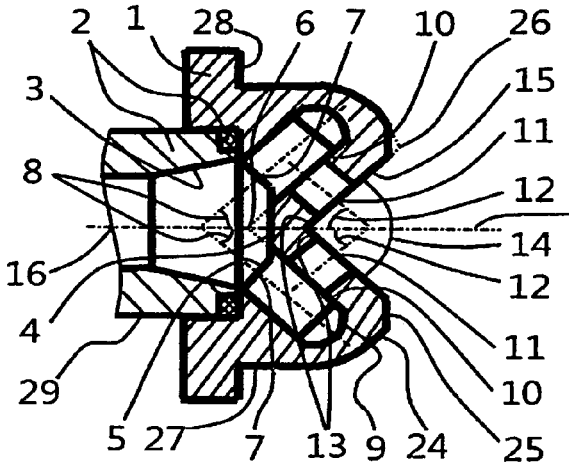
FIGS. 1A, 1B, 1C, 1D, 1E and 1F show a configuration of spray nozzle design.
Figure 1B:
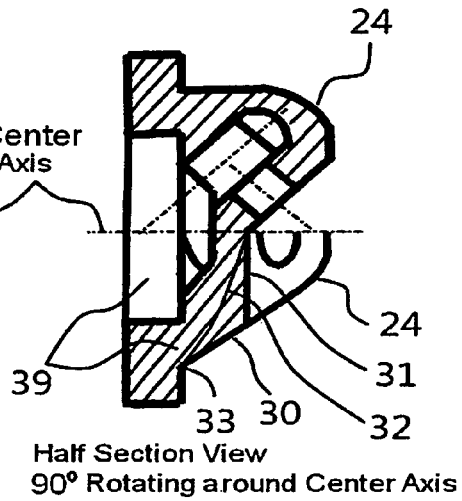
Figure 1C:
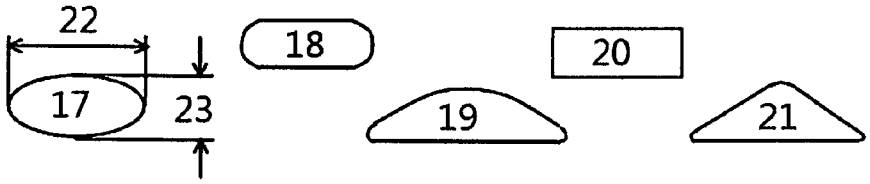

FIG. 1A, FIG. 1B and FIG. 1C show a spray nozzle design and the configuration. A spray nozzle 1 is assembled with a seal assembly 2, which is designed variously to meet the internal flow requirements of the nozzle 1 and the system to be applied with. The angle of taper 3 is defined between 0 degrees and 180 degrees and the surface is a concave surface or a convex surface to allow the fluid smoothly flow into the holes 7. The internal flow channel is designed with a flat surface 4 and a taper surface 5, or combined to one radius surface together, any other shape or intersected at point 6 to allow the fluid smoothly flow into holes 7. The holes 7 are manufactured with angle 8 between 15 degrees and 75 degrees. The holes 7 are tapered between 0 and 45 degrees. The surfaces 9 is a radius surface or other different shapes such as the taper, flat, etc. The distance 10 from the edge of the hole 11 is 0.1 at least times of hole size 11 to have a better fluid flow. The angle 12 of the hole 11 is between 15 degrees and 80 degrees and the center line of hole 11 is vertical (+/−45 degrees) to the center line of the hole 7. The distance 13 is between 0.0 inches and 5 times of the hole size 11. The hole size 11 is determined by the design conditions and requirements including the flow rate, fluid viscosity, atomization and pressure requirements.

The total cross section of the holes 7 and the inlet hole 16 are same as the holes 11, or increased gradually from the outlet orifices 11 to the inlet hole 16. The shape of the holes 7 and 11 is either a circle or other shapes such as the shapes of 17, 18, 19, 20 and 21 shown in FIG. 1C. The ratio of Width 23/Height 22 is between 0.5 and 10.0.

The V cutter angle 14 is defined between 30 degrees and 160 degrees depending on the flow pattern, the pressure and the atomization requirements. The center line of the hole 11 is vertical (+/−45 Degrees) to the V cutter surfaces 15. The V cutter surface 15 is a flat surface, a concave surface or a convex surface. The outside surface 24 is a radius or a chamfer. The top surface 25 is flat, or intersect at a point 26. The outside surface 27 is designed with or without a mounting flange plate 28. The size and shape of surface 27 are designed to meet the seal assembly 2. Generally, it is either a circle cross section or other shape such as the shapes of 17 and 18 depending on how to assemble the spray nozzle 1 with the seal assembly into the system. The surface 30 is a flat surface, a concave surface or a convex surface. The V cutter bottom line 31 is a vertical line as shown in FIG. 1B, a concave or a convex line 32 connected directly to the point 33, which helps to have a better gas/air flow.

Figures 1D, 1E, 1F:
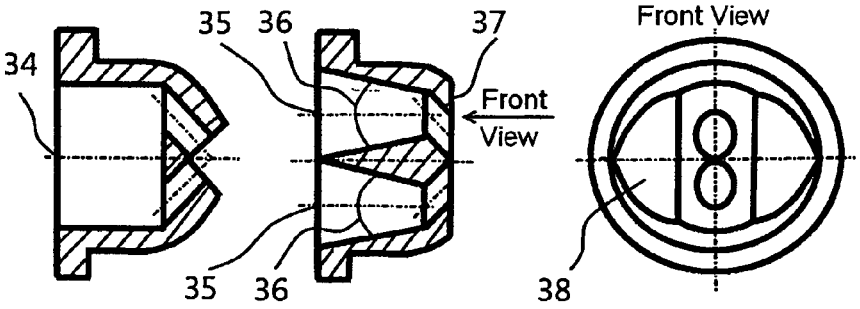

Instead of the holes 7, the internal fluid channel is also designed with one hole 34 shown in FIG. 1D, or two holes 35 shown in FIG. 1E which are designed symmetrically to one another with a taper angle 36 between 0 and 90 degrees.

The front surface 37 of the spray nozzle is made to a flat surface as shown in FIG. 1E or other curved surface such as a concave surface or a convex surface. The surface 38 shown in FIG. 1F is a flat surface, a concave surface or a convex surface.

Figure 2A:
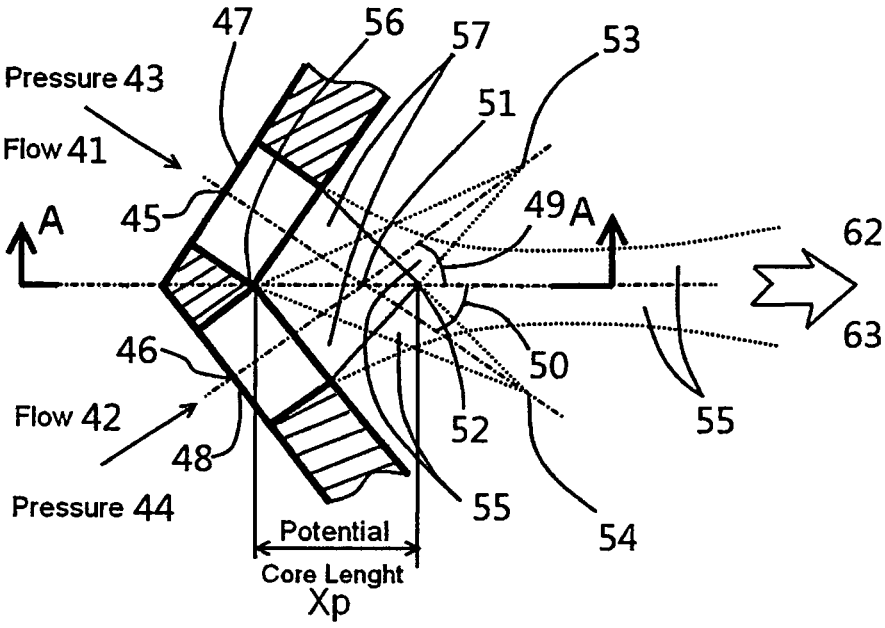
FIGS. 2A and 2B show the concept how the fluid flow collides and atomizes in a potential core.
Figure 2B:
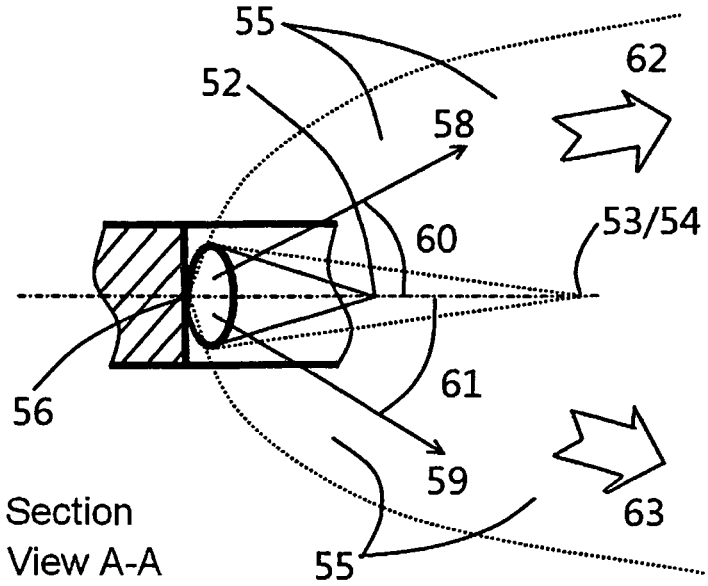

FIG. 2A and FIG. 2B show a concept how the fluid performs to form a uniform flow pattern and a fine atomization in the potential core right after flow out from the spray orifices. The fluid flow 41 and 42 under the pressure 43 and 44 go through the nozzle orifices 45 and 46 (or the orifice cross sections 47 and 48) with the fluid flow angles 49 and 50. The center lines of fluid flow intersect at the point 51 and the fluid—the gas/air mixing procedure finishes at the point 52. The area 57 before mixing the fluid with the gas/air and atomizing is the potential core, and the potential core length Xp between 56 and the point 52 is much shorter than the length of free flow jet between the orifice 45 outlet and the points 54, and between the orifice 46 outlet and the point 53. The fluid is atomized in the atomization area 55 which starts at the point 56 and at same time it is atomized in the potential core 57 as well during the fluid flows are interfering from the point 56 and changing the flow direction from the angles 49 and 50 to the directions 58 and 59 with the angle 60 and 61 shown in FIG. 2B. The fluid particles are atomized in the atomization area 55 continuously during going forward with the velocity 62 and 63. In according with this process, the fluid can be atomized directly and efficiently when mixing the fluid with the gas/air under a big velocity difference, transforming and utilizing both potential energy and velocity energy from the fluid to the particles and breaking up the fluid particles continuously inside and outside the potential core 57 during changing the fluid flow and the fluid particles' direction. The fluid flow pattern and distribution are formed fluidly and dynamically during interfering and changing the fluid flow and the particles' direction.

Figure 3A:
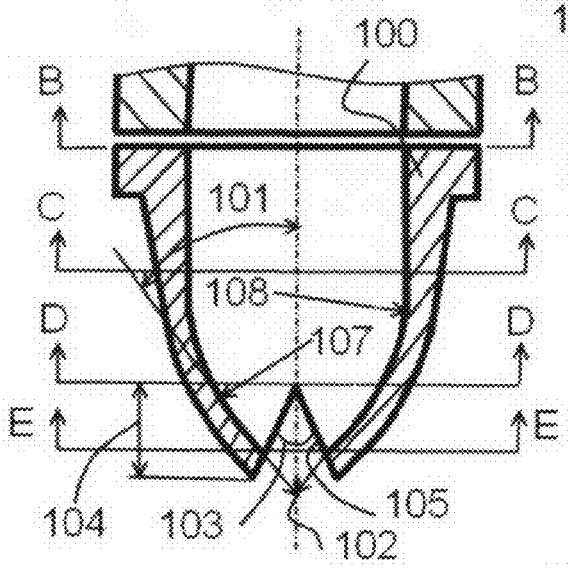
FIGS. 3A, 3B and 3C show the second configuration of spray nozzle design.
Figure 3B:
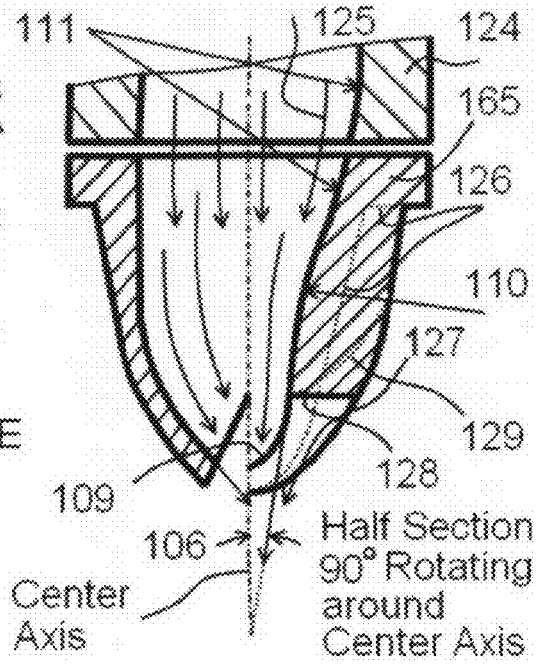
Figure 3C:
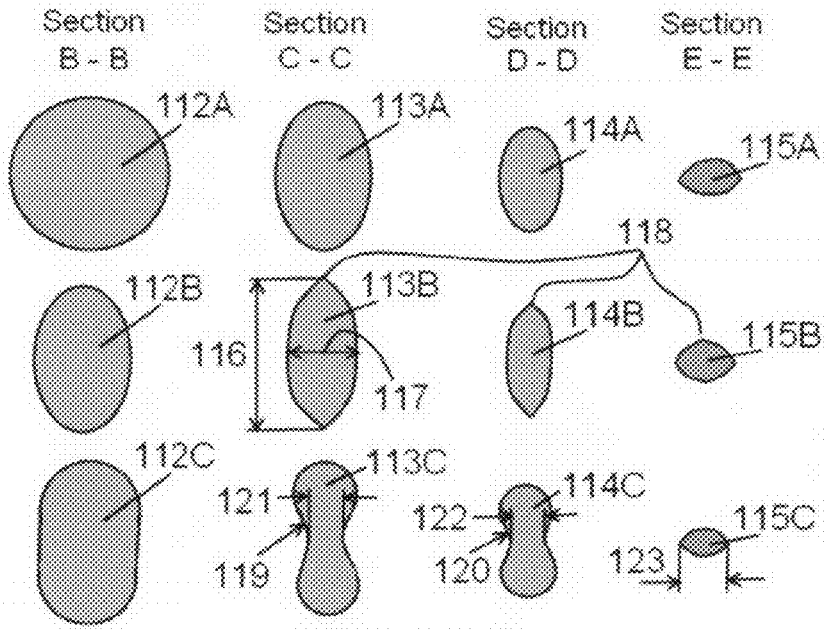

FIG. 3A, FIG. 3B and FIG. 3C show another spray nozzle design based on the same concept described above. The fluid flow under a specified pressure flows into a spray nozzle 100. The fluid outlet angle 101 is between 10 degrees and 80 degrees and the fluid flows are interfered at point 102. The V cutter angle 103 is between 30 degrees and 160 degrees. The depth 104 is determined by the angles 101, 103 and the requirements of the fluid flow rate, the atomization and the pattern. The V cutter surface 105 is flat or other curved surface. The side outlet angle 106 of the fluid flow shown in FIG. 3B is between −10 degrees and +45 degrees which helps to adjust the pattern shape, protect the flow bounce back, and meet atomization requirements.

The internal shape and the radius 107, 108, 109, 110 and 111 of the spray nozzle are all various and designed to the various cross section shapes such as the cross section shapes B-B, C-C, D-D and E-E shown in FIG. 3C. The internal cross section area is decreased gradually from the section B-B (112A, 112B, 112C or other shapes), the section C-C (113A, 113B, 113C or other shapes), the section D-D (114A, 114B, 114C or other shapes) to the section E-E (115A, 115B, 115C or other shapes). The rate of height 116/width 117 is between 10.0 and 0.25. The corner 118 is made to a curved surface, depending on how it is manufactured. The radius 119 and 120 are various and the width 121,122 and 123 are the same size, or smaller or bigger than one another to meet and adjust the internal fluid flow direction and the side flow angle 106.

The sections B-B, C-C, D-D and C-C show some of examples with different shapes, which meet the concept and the fluid flow requirements. The extension 124 is used for pre-adjusting fluid flow direction 125. The outside shapes and the mounting dimensions of the spray nozzle are the same as, or similar to the first configuration described above, or following the internal shape of the spray nozzle to make a narrow shape up to line 126 and have a better gas/air flow 127. The V cutter bottom line 128 is a horizontal line, a straight or a curved line 129 as shown in FIG. 3B, which helps to have a better gas/air flow 127.

FIG. 4 shows a half of section of the nozzle design with an additional isolation insert based on the same concept described above. The design of spray nozzle is the same configuration mentioned above except adding with the isolation insert 150 which helps isolate and guide the fluid flow to two main flows. The flow outlet angle 151 is between 10 degrees and 75 degrees which helps adjust and guide the fluid flow direction to meet the requirements. The surfaces 152 and 153 are radius surfaces, taper, cylinder, or other shapes. The width 156 shown in FIG. 4B is same as or smaller than the internal width 154 of spray nozzle 155 to allow the flow go through, meet the requirements of fluid flow pattern and atomization and protect the flow bounce back. The insert holes 157 have different shape such as a circle, or ellipse, but these holes must be designed symmetrically on vertical and horizontal directions with an even number of holes. The insert 150 is assembled with seal assembly 158.

FIG. 5 shows a half section 164 of the spray nozzle shown in FIG. 1B and a half of section 165 of the spray nozzle shown in FIG. 3B. Both spray nozzles have an additional 2 to 4 smaller holes 160 and 161 as shown in FIG. 5 to obtain a better flow pattern, atomization and protect the flow bounce back. The hole size are ¼ or less of the center hole cross section of the nozzle outlet, the angles 162 and 163 of the holes are between −15 degrees and +25 degrees and the hole shape is a circle cross section or any others such as the shapes of 17, 18 and 19 in FIG. 1C.

The spray nozzle is designed un-symmetrically to meet special pattern shape requirements. As an example, FIG. 6 shows a Moon Flow Pattern Section shape 170, which is performed and created by making different outlet hole size 11 (Ratio 0.5-2.0), adjusting the hole angles 12 (range 0-90 degrees), the distance 13, etc shown in FIG. 1A to obtain two different flows from left 171 and right 172 as shown in FIG. 6. These two flows are interfered at a designed point and form a required moon fluid flow pattern shape 170. The Moon Flow Pattern Section is used for an internal flow application including engine fuel jets, oven oil jets, etc.

Based on the designs and the concept described above, this invention requires much less power to meet a lower pressure requirement. In other words, all power suppliers and the systems installed with the spray nozzles and the units are to be much smaller and more convenient.

Based on the designs and the concept described above, this invention reduces the pressure greatly as generally required, so that the total fluid flow outlet size will be much bigger than the current one to meet a large flow rate requirement, and the nozzle material will be much softer than the existing one by using SS instead of Carbide, plated Alum or brass instead of SS, and hard plastic instead of alum, brass, etc.

Based on the designs and the concept described above, this invention is applied and used with gas/air assistant systems such as the airless and air assistant spray guns or other equipments. Since the fluid flow pressure is much lower with a better atomization, the new systems will require less gas/air and lower pressure to have the same or better performance and be more environmentally beneficial.

I claim as my invention:

1. A spray nozzle for obtaining a fine atomization and uniform flow pattern, comprising:

a seal assembly that has an internal fluid passage designed to allow the fluid to smoothly flow into said spray nozzle;

two of internal fluid passage holes being designed symmetrically to one another with a smooth internal fluid passage of said spray nozzle;

a large center hole being designed with a smooth internal fluid passage of said spray nozzle;

two independent holes parallel to the center axis being designed symmetrically to one another with a taper angle between 0 degrees and 90 degrees with a smooth internal fluid passage of said spray nozzle;

at least two outlet fluid orifices of said spray nozzle being designed with an angle of the center axis of said spray nozzle between 15 degrees and 80 degrees; The number of said outlet fluid orifices is two, three or more to meet fluid flow pattern requirements;

total cross section of said outlet orifices having a same size as or greater than the internal cross sections of said spray nozzle and said seal assembly, wherein the total cross section is increasing gradually from said outlet fluid orifice of said spray nozzle to said inlet of said seal assembly;

the shape of said internal fluid passage holes and said outlet orifices being a circle or other shapes such as an ellipse, rectangle, etc.

the ratio of the width divided by the height of said internal fluid passage holes and said outlet fluid holes being between 0.5 and 10.0;

a V cutter angle being between 30 degrees and 160 degrees with flat surfaces or other curved surfaces such as U shape on both sides;

a bottom line of said V cutter being a straight line vertical to said center axis of said spray nozzle, a straight line with an angle between 0 degrees and 45 degrees of said center axis, or any curved line to have a better gas/air flow;

the outside surfaces of said nozzle being varied such as flat surfaces, curved surfaces, etc depending on the requirements of gas/air flowing smoothly.

2. The spray nozzle of claim 1, wherein said fluid flow goes through said spray nozzle and is divided into two main flows before flowing out from the outlet of said spray nozzle; the fluid flows are pressed out at a fluid flow angle, then interfered with each other in the potential core adjacent to the outlet of said spray nozzle; the fluidflow is atomized quickly and efficiently when mixing the fluid with gas/air because of the big velocity difference, transforming the energy from the fluid to the particles inside and outside of said potential core during changing the direction of the fluid flow and the fluid particles, and breaking up the fluid particles continuously during going forward; the fluid flow pattern and distribution is formed fluidly and dynamically during interfering and changing the fluid flow and the particles' direction.

3. The spray nozzle of claim 1, comprising:

a narrow shape of internal cross section of said spray nozzle being provided to guide and adjust the fluid flow to two main flows before flowing out from said spray nozzle;

the main flow outlet angles of said spray nozzle being between 10 degrees and 80 degrees;

the side fluid flow outlet angles on the side section which is rotating 90 degrees around the center axis of said spray nozzle being between −10 degrees and +45 degrees;

a V cutter angle being between 30 degrees and 160 degrees with flat surfaces or other curved surface on both sides;

the areas of said internal cross section being decreased gradually from the inlet to the outlet of said spray nozzle;

the shapes of said internal cross section being a circle, ellipse or other shapes to meet fluid flow requirements as same as claim 1; the surface connected to each internal cross section are various depending on the location and shapes of said internal cross section;

the ratio of height divided by width of said internal cross section shape being between 10.0 and 0.25;

the corner of said internal cross section shape being a small radius, a straight line or other curved lines;

the width at the center of said internal cross section shape being smaller than said width of said internal cross section shape;

an extension with various cross sections being used for pre-adjusting fluid flow direction to meet the shape of said inlet of said spray nozzle before flowing into said spray nozzle; and the outside shapes, the bottom line of said V cutter and the mounting dimensions of said spray nozzle being the same as claim 1, or following the internal cross section shapes of said spray nozzle to make a narrow shape to have a better air flow.

4. The spray nozzle of claim 1, comprising:

an insert being applied and assembled with said spray nozzle of claim 3 to guide and separate the fluid flow to two main flows before flowed out from the said spray nozzle;

the flow outlet angle of said insert being between 10 degrees and 75 degrees;

the surface of said insert being made by rotating a radius line around the center axis of said spray nozzle;

an insert plate being applied and assembled with said spray nozzle of claim 3 to guide and separate the fluid flow to two main flows before flowed out from the said spray nozzle;

the width of said insert being same as or smaller than the internal width at the center of said spray nozzle of claim 3 to allow the flow go through and meet the requirements of fluid flow pattern and atomization;

the passage holes of said insert being various shapes such as a circle or ellipse, but must be symmetrically on both vertical and horizontal directions of said center axis with an even number of the holes; and a spray nozzle as defined in claim 3, wherein said insert is assembled with said seal assembly of claim 1 or the extension of claim 3.

5. The spray nozzle of claim 1, comprising:

two or four additional assistant holes being added to said spray nozzles of claim 4;

Said assistant holes being made to go through the bottom line of said V cutter of claim 4;

said assistant hole size being ¼ or smaller of the center hole cross section of said spray nozzle;

the angles of said assistant holes being between −15 degrees and +25 degrees; and the cross section shape of said assistant holes being a circle or other shapes such as an ellipse, rectangle, etc.

6. The spray nozzle of claim 1, comprising:

said outlet orifices of claim 1 being made to different sizes; and said internal cross section of claim 3 being made un-symmetrically to provide the different flow from left to right and to form a special flow pattern section requirements such as a moon shape.

* * * * *